US005595556A

United States Patent [19]

Dalebout et al.

[11] Patent Number: 5,595,556

[45] **Date of Patent: *Jan. 21, 1997**

[54] TREADMILL WITH UPPER BODY SYSTEM

[75] Inventors: William T. Dalebout; Scott R. Watterson, both of Logan, Utah

[73] Assignee: ICON Health & Fitness, Inc., Logan, Utah

[ * ] Notice: The term of this patent shall not extend beyond the expiration date of Pat. No. 5,282,776.

[21] Appl. No.: 189,582

[22] Filed: Jan. 31, 1994

Related U.S. Application Data

[63] Continuation-in-part of Ser. No. 13,637, Feb. 4, 1993, Pat. No. 5,282,776, which is a continuation-in-part of Ser. No. 954,299, Sep. 30, 1992, abandoned.

[51] Int. Cl.[6] ..... A63B 22/02; A63B 21/015

[52] U.S. Cl. ..... 482/54; 482/118; 482/51; 482/70

[58] Field of Search ..... 482/54, 51, 52, 482/53, 70, 139, 114, 115, 118

[56] References Cited

U.S. PATENT DOCUMENTS

| | | | |
|---|---|---|---|
| D. 211,801 | 7/1968 | Quinton . | |
| D. 345,998 | 4/1994 | Gresko . | |
| 881,521 | 5/1908 | Wilson . | |
| 1,082,940 | 12/1913 | Flora et al. . | |
| 1,982,843 | 12/1934 | Traver . | |
| 2,315,485 | 4/1943 | Jones . | |
| 2,646,282 | 7/1953 | Ringman . | |
| 2,969,060 | 7/1961 | Swanda et al. . | |
| 3,193,287 | 7/1965 | Robinson . | |
| 3,345,067 | 10/1967 | Smith . | |
| 3,408,067 | 10/1968 | Armstrong | 482/70 |
| 3,566,861 | 3/1971 | Weiss . | |
| 3,638,941 | 2/1972 | Kulkens . | |
| 3,659,845 | 5/1972 | Quinton . | |
| 3,731,917 | 5/1973 | Townsend | 482/54 |

(List continued on next page.)

FOREIGN PATENT DOCUMENTS 8201138 4/1982 WIPO .

OTHER PUBLICATIONS

Copy of brochure entitled "Technology for Total Fitness Genesis" 1000–1985 –6 pages.

Copy of brochure entitled "Technology for Total Fitness Genesis" 2000 –1985–6 pages.

Copy of brouchure entitled "Technology for Total Fitness Genesis" 3000–1985–7 pages.

Weslo Ascent II Dual stepper, Model No. WL20082, single–page ad slick, Coypright 1992.

Weslo Ascent II stepper, Model No. WL200821, 12–page onwer's manual, copyright 1992, Jan. 1993.

Proform Club Sx2 stepper, Model No. PF20152, single–page ad slick, Copyright 1992.

Proform Club Sx2 stepper, Model No. PF201522, 12–page Owner's manual, Jan. 1993.

Weslo Glide MDX skier, two–page brochure, copyright 1991–1992.

Weslo Glide MDX skier, Model No. WL611020, 12–page owner's manual, May 1993.

Weslo Glide MDX Plus skier, two–page brochure, copyright 1991–1992.

Weslo Glide MDX plus, Model No. WL611520, 12–page Owner's manual, copyright 1992.

(List continued on next page.)

*Primary Examiner*—Lynne A. Reichard
*Attorney, Agent, or Firm*—Trask, Britt & Rossa

[57] ABSTRACT

A treadmill including an upper body system for manipulation by the upper extremities of a user walking or jogging on the treadmill belt. The upper body system includes pivotally mounted lever arms having substantially constant but adjustable resistance to rotational reciprocation by the user, such as a frictional resistance. The pivot points of the lever arms may be adjustable as to both height and longitudinal position on the treadmill, to accommodate different sized users and different exercises.

5 Claims, 4 Drawing Sheets

U.S. PATENT DOCUMENTS

| | | | |
|---|---|---|---|
| 3,792,860 | 2/1974 | Selnes . | |
| 3,814,420 | 6/1974 | Encke . | |
| 3,870,297 | 3/1975 | Elder . | |
| 3,941,377 | 3/1976 | Lie | 482/70 |
| 4,012,015 | 3/1977 | Nelson et al. . | |
| 4,188,030 | 2/1980 | Hooper . | |
| 4,204,673 | 5/1980 | Speer et al. . | |
| 4,274,625 | 6/1981 | Gaetano . | |
| 4,313,603 | 2/1982 | Simjian . | |
| 4,502,679 | 3/1985 | DeLorenzo . | |
| 4,529,194 | 7/1985 | Heeheim . | |
| 4,563,001 | 1/1986 | Terauds . | |
| 4,566,689 | 1/1986 | Ogden . | |
| 4,618,139 | 10/1986 | Haaheim . | |
| 4,621,623 | 11/1986 | Wang . | |
| 4,625,962 | 12/1986 | Street . | |
| 4,632,385 | 12/1986 | Geraci . | |
| 4,647,041 | 3/1987 | Whiteley . | |
| 4,679,787 | 7/1987 | Guilbault . | |
| 4,729,558 | 3/1988 | Kao . | |
| 4,743,015 | 5/1988 | Marshall . | |
| 4,804,178 | 2/1989 | Freidbach . | |
| 4,813,667 | 3/1989 | Watterson . | |
| 4,830,362 | 5/1989 | Bull . | |
| 4,832,332 | 5/1989 | Dumbser . | |
| 4,838,544 | 6/1989 | Sasakawa et al. . | |
| 4,850,585 | 7/1989 | Dalebout . | |
| 4,869,493 | 9/1989 | Johnston . | |
| 4,869,494 | 9/1989 | Lambert, Sr. . | |
| 4,909,504 | 3/1990 | Yang . | |
| 4,934,690 | 6/1990 | Bull . | |
| 4,948,121 | 8/1990 | Haaheim et al. . | |
| 4,971,316 | 11/1990 | Dalebout et al. . | |
| 5,000,440 | 3/1991 | Lynch . | |
| 5,000,442 | 3/1991 | Dalebout et al. . | |
| 5,004,224 | 4/1991 | Wang . | |
| 5,007,631 | 4/1991 | Wang . | |
| 5,013,031 | 5/1991 | Bull . | |
| 5,016,870 | 5/1991 | Bulloch et al. . | |
| 5,054,770 | 10/1991 | Bull . | |
| 5,058,882 | 10/1991 | Dalebout et al. . | |
| 5,074,550 | 12/1991 | Sloan . | |
| 5,102,380 | 4/1992 | Jacobson et al. . | |
| 5,104,119 | 4/1992 | Lynch . | |
| 5,108,093 | 4/1992 | Watterson . | |
| 5,110,117 | 5/1992 | Fisher et al. . | |
| 5,129,872 | 7/1992 | Dalton et al. . | |
| 5,145,481 | 9/1992 | Freidbach . | |
| 5,149,312 | 9/1992 | Croft et al. . | |
| 5,181,894 | 1/1993 | Shieng . | |
| 5,207,622 | 5/1993 | Wilkinson et al. . | |
| 5,226,866 | 7/1993 | Engel et al. . | |
| 5,441,467 | 8/1995 | Stevens . | |
| 5,460,586 | 10/1995 | Wilkinson et al. . | |

OTHER PUBLICATIONS

Proform Nordic Kick XC, two–page brochure, copyright 1991–1992.

Proform Nordic Kick Plus, Model No. PF60152, single–page as slick, Copyright 1992.

Proform 570XC skier, Model No. PF60153, single–page ad slick, Copyright 1992.

Proform 570 XC skier, Model No. PF601530, 12–page owner's manual, May 1993.

Proform Club SX2 stepper, two–page brochure, copyright 1991–1992.

Proform Synchro Step stepper, two–page brochure, copyright 1991–1992.

Proform Cross Walk treadmill Model No. DR70502, single–page ad slick, Copyright 1992.

Proform T80 treadmill Owner's Manual (8 pages) dated Oct. 1988.

Weslo PowerGlide XCS X–Country Skier, Model No. WL61070, single–page ad slick, Copyright 1990.

Proform Kick XCS skier, Model No. PF600300, 12–page owner's manual, Jul. 1990.

Proform Step USA II stepper, Model No. PF10501, single–page ad slick, Copyright 1991.

Weslo PowerGlide 50 skier/rower, Model No. WL610301, 12–page Owner's Manual, Jun. 1990.

Weslo PowerGlide 50 skier/rower, Model No. WL610520, 12–page Owner's Manual, Jul. 1992.

Fitness Master FM320 Skier, 18–page owner's manual, copyright 1991.

Schwinn Air–Dyne Owner's Manual, 25 pages, copyright 1984.

Lifestyler AirCycle owner's manual, dated Jun. 1991, 12 pages.

Advertisement for UB Sports Fitness Trainer, Sports Tech Services, Inc., Club Industry, Oct. 1992, front cover and p. 93.

Proform Tailwind stationary cycle, Model No. PF41130, single–page ad slick, Copyright 1990.

"Strider" Brochure, Fitness Tread/Systems Inc. 8 pages undated.

"Cross country ski exercisers", Consumer Reports, November 1986, 747–749.

TREADMILL WITH UPPER BODY SYSTEM

This application is a continuation-in-part of U.S. patent application Ser. No. 08/013,637 filed Feb. 4, 1993, now U.S. Pat. No. 5,282,776, issued Feb. 1, 1994, which is a continuation-in-part of U.S. patent application Ser. No. 07/954,299 filed Sep. 30, 1992, abandoned.

BACKGROUND OF THE INVENTION

1. Field of the Invention

The present invention relates generally to treadmills, and more specifically to treadmills incorporating apparatus for exercising the upper body of the user, alone or in association with movement on the treadmill.

2. State of the Art

In recent years, motorized treadmills become increasingly popular as a means for obtaining beneficial aerobic exercise. Many improvements to treadmills have been introduced to enhance their utility and broaden their appeal, including inclination and speed adjustments, programmed and programmable exercise routines, shock absorption, pulse monitoring and "dead man" shutoff switches for safety.

When exercising on a typical motorized treadmill, the user normally employs muscle groups in the lower body. Such machines have specifically not addressed the needs of the user to exercise the upper body. Recently issued U.S. Pat. No. 5,110,117, (Fisher et al.), discloses a treadmill with moveable handles to be grasped by the user for exercising the upper body of the user while walking on the treadmill belt. The device of the '117 patent, which also is exemplified by the STRIDER treadmill line offered by Fitness Trend/Systems, Inc. of Independence, Mo., employs spring-loaded handles pivotally mounted on each side of the treadmill belt in the middle of the treadmill. The handles also extend upwardly through the side surfaces or chassis adjacent the treadmill belt. The handles are biased against pivotal movement in both forward and backward directions toward a central, neutral position.

The device of the '117 patent, while an advance in the treadmill art, falls short of an ideal treadmill with upper body exerciser. For example, the force to be applied to the handles by the user is difficult to adjust, as it requires the user to lift up the treadmill from the floor and adjust set screws or nuts from the inside of the longitudinal treadmill side frame elements or side surfaces.

Further, the handles of the treadmill shown in the '117 patent extend upwardly through the side surfaces or chassis at the middle of the treadmill and thereby inhibit the user from easily stepping from the tread onto the side surfaces to dismount from a moving tread. Similarly, the handles prevent the user from straddling the tread or stepping on the side surface in the process of mounting the treadmill and especially a treadmill with a moving tread. That is, the user typically prefers to step onto the moving tread at or forward of the midpoint so that the user has time to begin walking or jogging before reaching the tail roller or pulley.

SUMMARY OF THE INVENTION

A treadmill incorporates an upper body exercise system which is simple, inexpensive to produce and assemble. It also provides a substantially even or constant resistance to movement of the user's arms which is also easily and readily adjustable by the user without manipulation of the treadmill from its normal resting position on the floor.

The treadmill of the present invention affords the user the opportunity for lower body exercise only, upper body exercise only, or combined upper and lower body exercise for a simultaneous total body workout. That is to say, the upper and lower body exercise mechanisms are completely independent of each other, and the user may stand on the treadmill belt while it is motionless and position and reposition himself or herself to perform various upper body exercises. Alternatively, the user may merely stride on the moving treadmill belt and forego upper body work. Finally, the user may stride on the moving treadmill belt while manipulating the upper body system.

The present invention also contemplates an upper body exercise system adaptable to existing treadmills, and which may be provided as an add-on feature to treadmills designed for attachment of the upper body system subsequent to purchase of the treadmill. The upper body exercise system of the present invention is also of a design and configuration to permit folding or collapsing thereof with the column or pedestal of the treadmill to a position overlying the treadmill belt for easier shipping and storage. In turn, the unit may be shipped completely assembled and ready for use or nearly so.

The present invention comprises first and second lever arms pivotally mounted to the treadmill frame and restrained against free pivotal movement by resistance means which provide a substantially constant resistance to pivotal movement in both forward and rearward directions. In a preferred embodiment, the resistance is adjustable and comprises a frictional resistance, such as resistance pads sliding across a surface as the lever arms are pivotally reciprocated by the user. An alternative resistance means, such as hydraulic or pneumatic cylinders, may be employed but such devices are presently less preferred (except for certain applications disclosed hereafter).

One preferred mounting location for the lever arms is at the front of the treadmill and above the frame. The lever arms may be mounted at a common point, such as at or to the base of a pedestal or column which typically supports a console with controls for treadmill incline and speed and readouts of monitored bodily functions of the user, such as pulse. In this location, the arms as well as the pedestal or column may be released to fold over the treadmill belt, thus providing a low profile for easy shipping and storage. Each lever arm may also be secured at a fixed position, along the side rails. The lever arms may also be longitudinally relocatable so that the user may adjust the lever arm pivot positions to individual preference, or change their location to perform different arm movements and exercises. If desired, the lever arms may be made adjustable in length so as to more closely adapt to the height and reach of a wide variety of potential users, and handles at the free ends of the lever arms may be movable to different positions for different exercises.

BRIEF DESCRIPTION OF THE DRAWINGS

The present invention will be more fully understood by one of ordinary skill in the art through a review of the following detailed description of the preferred embodiments in conjunction with the accompanying drawings, wherein.

DETAILED DESCRIPTION OF THE PREFERRED EMBODIMENTS

Figure 1:
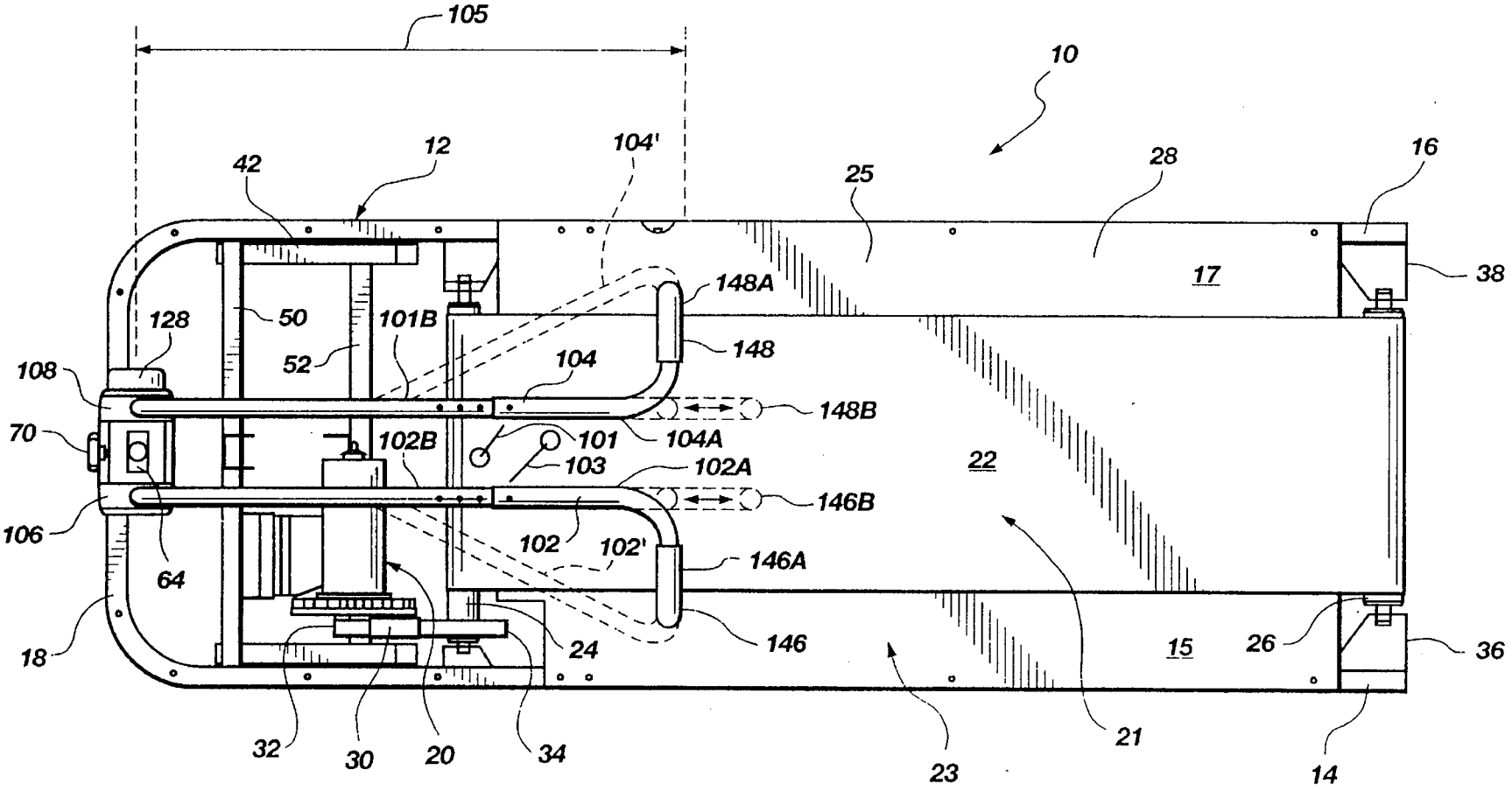
FIG. 1 is a top, partially cutaway elevation of a treadmill incorporating an upper body system in accordance with the present invention.
Figure 2:
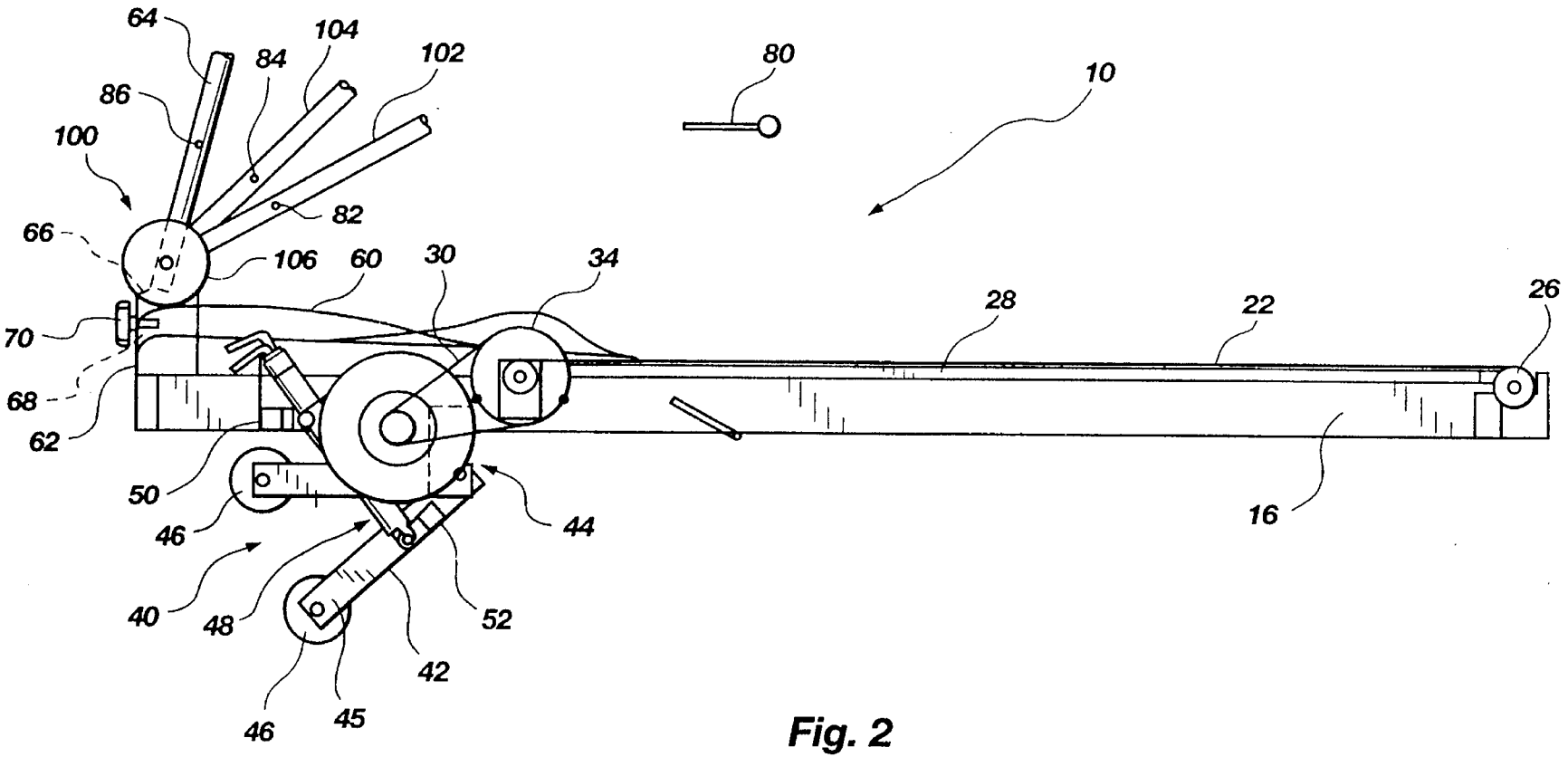
FIG. 2 is a side sectional elevation of the treadmill depicted in FIG. 1.

Referring to FIGS. 1 and 2 of the drawings, treadmill 10 includes a generally U-shaped frame 12 having longitudinally-extending side rails 14 and 16 which extend into transverse front base 18 of frame 10. An electric motor 20 is provided to drive endless treadmill belt 22 which extends longitudinally between front roller 24 and rear roller 26 over treadmill deck 28. Front roller 24 is driven by motor 20 via drive belt 30, which extends frown motor drive pulley 32 to enlarged driven pulley 34 interconnected to one end of the front roller 24. The pulley 34 and pulley 32 reduce motor speed and increase the torque to drive front roller 24. Rear roller 26 is freewheeling, and extends between roller brackets 36 and 38 to act as a rear portion of frame 12.

At the front end of treadmill 10, an inclination mechanism (shown in FIG. 2 in both retracted and extended positions) generally designated as 40 provides the treadmill user with the ability to raise and lower the front end of treadmill 10 to vary the difficulty of walking or jogging on the treadmill belt 22. Inclination mechanism 40 as shown includes a subframe 42 pivoted at 44 and having wheels 46 on its lower, outer end 45. Gas cylinder 48 is pivotally mounted at its upper end to crossmember 50 of frame 10, and at its lower end to crossmember 52 of subframe 42. The user can shift his or her weight on the treadmill 10 while opening a valve in gas cylinder 48 to raise or lower the inclination of treadmill 10, subsequently closing the valve to fix the inclination.

The motor 20 and other belt-drive components, as well as the inclination mechanism 40, are covered by hood 60. The hood 60 extends from the forward portion of treadmill belt 22 up to and around the standard 62. The pedestal or column 64 is secured to the standard 62 by bracket 66 and bolt 68, which includes enlarged head 70 for rotation and tightening by the hand of the user. Pedestal or column 64 supports a control console (not shown) at its upper end.

Figure 3:
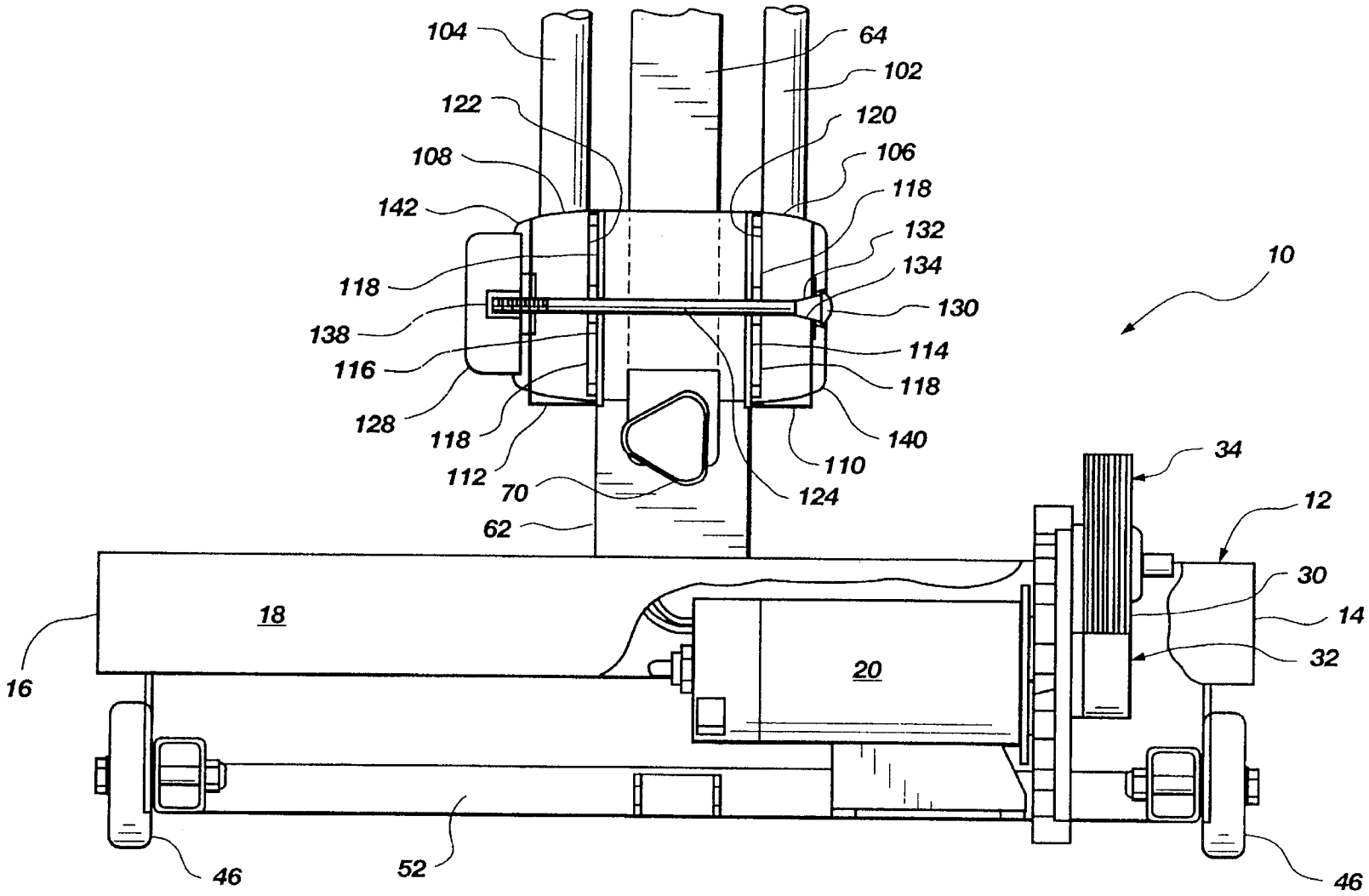
FIG. 3 is an enlarged, partial sectional frontal elevation of the treadmill of FIG. 1, depicting the mounting and resistance mechanisms employed for a preferred embodiment of the upper body system of the present invention.

Referring to FIGS. 1–3 and particularly to FIG. 3, upper body system 100 in accordance with the present invention includes first and second lever arms 102 and 104 extending upwardly frown their respective bases 106 and 108, one on each side of standard 62. L-shaped brackets 110 and 112 extend laterally from standard 62, to which they are affixed, as by welding. The upper portion of each side of standard 62 comprises frictional resistance surfaces 114 and 116, against which bear a plurality (typically four) friction pads 118 adhesively affixed to the inner faces 120 and 122 of lever arm bases 106 and 108. Frictional resistance surfaces 114 and 116 are devoid of paint or other coatings which would abrade off of the metal and of standard 62 and fill the pores of friction pads 118. If desired, frictional resistance surfaces 114 and 116 may comprise discs of bare metal affixed to the exterior of standard 62. To hold bases 106 and 108 against standard 62 and to provide a pivot point for lower arms 102 and 104, carriage bolt 124 extends through L-bracket 110, base 106, standard 62, base 108 and L-bracket 112 and into adjustment knob 128. The head 130 of carriage bolt 124 abuts but preferably does not contact L-bracket 110, while square/cross-sectioned and tapered head base 132 extends through arm mates with a square aperture 134 in L-bracket 110, securing carriage bolt 124 against rotation. The end of carriage bolt 124 opposite head 130 is threaded at 136, and engages the internally threaded metal sleeve 138 which has been molded into the plastic material of adjustment knob 128. For cosmetic purposes, caps 140 and 142 are secured to (such as by double-sided adhesive tape) and over L-brackets 110 and 112, and include apertures in their centers large enough to accommodate bolt head 130 and threaded portion of carriage bolt 136 without interference.

To adjust the frictional resistance to rotation afforded by the movement of frictional resistance surfaces 114 and 116 against friction pads 118, adjustment knob 128 is merely rotated to increase or decrease the degree to which the friction pads 118 on bases 106 and 108 of lever arms 102 and 104 are pressed against frictional resistance surfaces 120 and 122. Since a single bolt passes through both bases, the same force is applied to both when knob 128 is tightened, the system thus being self-adjusting in the sense that both lever arms 102 and 104 are simultaneously set to the same resistance.

As best seen in FIG. 1, lever arms 102 and 104 are topped by handles 146 and 148 for grasping by the user and pivotal reciprocation in the performance of upper body exercises. If desired, lever arms 102 and 104 may extend substantially straight back from standard 62 as shown, with laterally outwardly extending handles. Alternately, the arms 102 and 104 may flare outwardly as depicted by broken lines at 102' and 104' to a transverse separation distance greater than the width of treadmill belt 22 and employ laterally inwardly extending handles. In addition, lever arms 102 and 104 may each comprise telescoping assemblies 102A and 102B and 104A and 104B so that the lengths 105 of lever arms 102 and 104 are easily adjustable with pins 101 and 103 for both short and tall users and for those with above and below average reach. Finally, handles 146 and 148 may be rotatable or otherwise moveable from a horizontal position 146A and 148A to different positions such as vertical position 146B and 148B, as depicted in broken lines (see FIG. 1).

It should be noted that pedestal or column 64 as well as lever arms 102 and 104 are pivotally mounted on standard 62 about carriage bolt 124. Thus, when bolt 68 is released from standard 62, lever arms 102 and 104 and pedestal or column 64 may rotationally fold over the treadmill hood 60 and treadmill belt 22 toward the rear of treadmill 10. This single point pivot and single point release feature greatly facilitates shipping of treadmill 10 in a compact container while promoting easy user set-up, and can also be used to diminish the bulk of treadmill 10 for storage.

It should also be noted that lever arms 102 and 104 may be selectively locked to pedestal or column 64 by suitable means such as a pin 80 which may be inserted through laterally alignable apertures 82 and 84 in lever arms 102 and 104 and aperture 86 in column 64. In such a manner arms 102 and 104 may be selectively locked to provide a substantially rigid support structure for the user to grasp when striding or jogging on the treadmill belt 22, or released so that the user may move lever arms 102 and 104 for upper body exercise.

Operation of treadmill 10 can, as previously noted, provide lower body exercise, upper body exercise or combined upper and lower body exercise for a simultaneous total body workout. For upper body exercise in particular, several options are available. For solely exercising the upper body, the user may stand on treadmill belt 22 while it is unpowered, and manipulate lever arms 102 and 104 while facing either forward or backward. Thus, presses, curls and other pushing and pulling exercises are easily achievable, unlike the treadmills of the prior art, and even the treadmill disclosed in the aforementioned U.S. Pat. No. 5,110,117 (Fisher et al.) In fact, the treadmill of the present invention also affords the user the ability to perform squats while standing on the motionless treadmill belt 22, and shoulder presses and bench presses while sitting or lying on the motionless belt.

It is worthwhile at this juncture to compare the treadmill of the present invention to nordic or cross-country ski exercisers of the prior art, in that most of same purport to afford the user both upper and lower body exercise. Many of these devices link the hand and arm movements to forcibly coordinate or synchronize the same. Of those skiers which offer independent upper and lower body movement, most of these only provide the user with the ability to pull, and not push, with the upper body extremities. Of the skiers that do offer a push/pull lever type resistance to the arms, the feet of the user are still constrained by the need to stand on moveable trolleys, skis or blocks, which are not fixable and are otherwise synchronized. In some instances, the user's feet in skier exercise machines are further constrained by stirrups to prevent lifting of the feet and disconnection of the user from the lower body resistance mechanism. Even in those skiers which do not laterally or vertically constrain the user's feet, the user still has no other location to place his or her feet on the device for varying position for more comfortable or different upper body exercises. In contrast, the user of the treadmill of the present invention may position himself or herself anywhere on the treadmill belt, with feet in any position and orientated in any direction, support being provided by treadmill deck 28.

The lower arm resistance employed in the present invention also presents advantages over the device of the '117 patent in that the resistance is regarded to be substantially constant or even over the entire range of motion in comparison to the spring resistance of the device of the '117 patent which resistance increases with the movement of the lever arms away from a central, or neutral point in the center of the rotation range. Thus, a user may be faced with a situation in which maximum load is placed on an extremity in a minimum leverage position.

Figure 4:
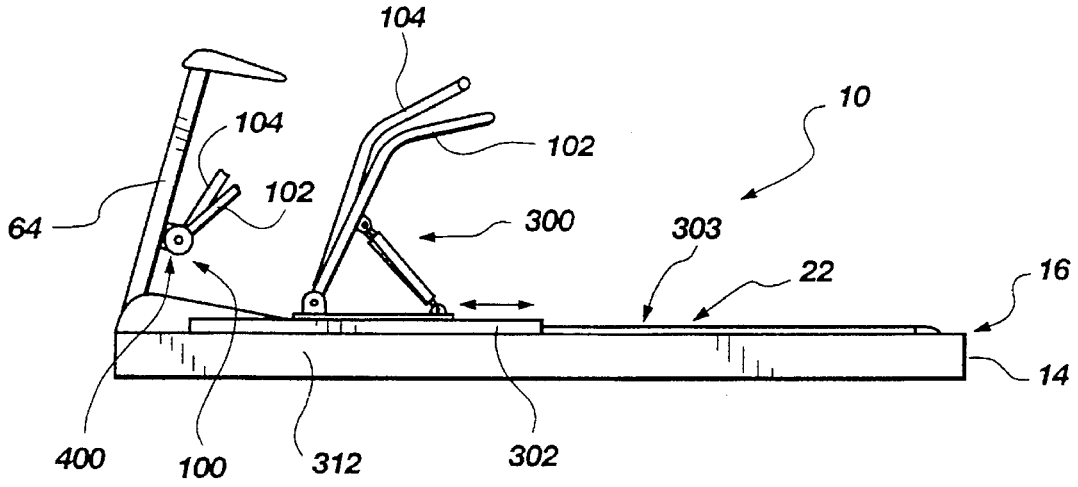
FIG. 4 is a schematic of a longitudinally-adjustable upper body system for a treadmill in accordance with the present invention and depicts alternative lever arm locations and an alternative resistance means for the upper body system.
Figure 5:
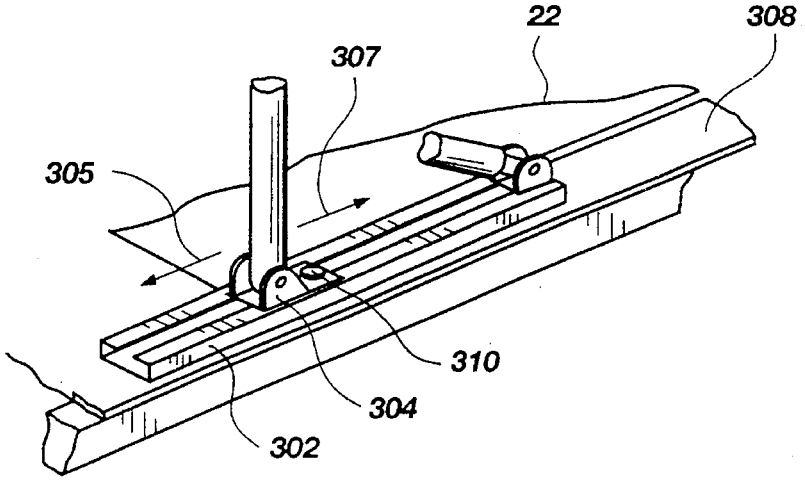
FIG. 5 is a partial perspective of the machine of FIG. 4.

Referring now to FIG. 4 of the drawings, lever arms 102 and 104 are shown mounted in outboard positions on each side of treadmill belt 22 on the tops of treadmill frame side rails 14 and 16. In the embodiment of FIG. 5, lever arms 102 and 104 are independently adjustable in terms of resistance and may employ a single-arm version of the tandem frictional resistance adjustment mechanism previously described. Alternatively, an adjustable hydraulic or pneumatic resistance 300 known in the art may be employed as shown. Thus, the resistance of both sides may be set to a specified setting, rather than to similar "feel" as would be the case when using separate frictional resistances.

In any event, the mounting points of lever arms 102 and 104 are longitudinally relocatable in a track 302 forward 305 and rearward 307 as shown in FIG. 5. The mechanism for effecting such longitudinal relocation is shown to include mounting each lever arm 102 and 104 to a carriage 304 riding on a slotted rail 302 on top of the frame side rail 14 or 16 or on the side surface 308. The carriage 304 is secured with a bolt 310 having a nut with a washer inside the T-shaped rail 302. The bolt thus can be loosened to provide for the longitudinal relocation forwardly 305 or rearwardly 307 as desired. Alternately, the carriage 304 of each lever arm 102 and 104 may be locked in place by a spring-loaded pin and plurality of cooperating apertures or by frictional engagement or by other means known in the art.

FIG. 4 also depicts an alternative embodiment of the invention wherein a treadmill 10 is designed and initially sold without the upper body system 100 of the present invention, but includes one or more threaded apertures in column 64 or standard 62 by which a box beam or other structure 400 carrying upper body system 100 may be bolted to treadmill 10. In such a manner, a more or less standard treadmill may be upgraded by an aftermarket purchase and installation of the upper body system of the present invention when the user desires to pursue upper body development, or merely wishes to add variety to the somewhat tedious activity of walking or jogging on the treadmill belt. A lever arm locking mechanism such as has been previously disclosed may be employed with this after-market upper body system.

With reference to the arms 102 and 104 in FIG. 4, it may be noted that each may be mounted to the treadmill to not interfere with mounting or dismounting by the user. In FIG. 4, the arms 102 and 104 are mounted forward of the midpoint or center area 303 of the treadmill side surfaces 308. The arms 102 and 104 may also be mounted to the outside 312 of the side rail 14 (or chassis) of the treadmill. The arms 102 and 104 may also be located forward 304 or under the treadmill frame 12. Thus the user may easily step sideways onto the surface 308 from a moving belt 22 to dismount. Similarly, the user can more readily mount the treadmill at a center or middle point to commence use.

More specifically, a user typically moves on the tread 22 at a rate to center his or her body at or very near the mid area 21 of the tread 22 (FIG. 1). If the user desires to mount a moving belt 22, the user may position one foot such as the left on the chassis or side surface 15 at a midpoint 23. The user then moves the other foot such as the right foot on the moving belt 22 and immediately commences exercise to avoid being projected over the tail pulley 26.

Alternately, a user may place the left foot at the left middle point of the side surface 15 and the right foot at the right middle point 25 of the side surface 17. In effect, the user straddles the belt 22. The user may then place one foot and then the other on the belt 22 to commence exercise.

To dismount from a moving belt 22, the user may put one foot on either the left or right center points 23 and 25 of side surface 15 and 17 and unweight the other, similar to dismounting from a bicycle or horse. Alternately, the user may move both feet outwardly to straddle the belt 22. In all cases, the arms 102 and 104 are secured to the treadmill at a location to leave clear and open for use the area that is the left middle point 23 and right middle point 25 of the side surfaces 15 and 17.

With the belt stopped, the user may also stand on the belt and manipulate lever arms 102 and 104. The user may also kneel, sit and lay prone in a variety of orientations to manipulate lever arms 102 and 104 with his or her arms and legs to perform alternate exercises.

Lever arms 102 and 104, described above, may be mounted to the outside of the side rails 14 and 16 outwardly from the side surfaces as well as forward on the side rails or side surface. Also, the arms 102 and 104 may be connected by a cable, rope or the like through a resistance mechanism. Other configuration of arms or their equivalent may include cables or ropes extending rearwardly from a resistance structure positioned forward of the tread 22. The resistance may be configured to allow the cable or ropes to be moved by the user separately or alternately against a resistance such as friction applied to a pulley or even weights.

While the present invention has been described in terms of certain exemplary embodiments, it will be readily understood and appreciated by one of ordinary skill in the art that it is not so limited, and that many additions, deletions and modifications to the preferred embodiments may be made within the scope of the invention as hereinafter claimed.

What is claimed is:

1. A treadmill having structure operable for exercising the upper body of a user, said treadmill comprising:

a frame having a front end, a rear end, and laterally spaced right and left sides;

a movable endless belt rotatably mounted to said frame rearward of said front end and between said right and left sides, said endless belt being formed to support a user thereon;

first and second rigid lever arms each having an upper end and each being pivotally mounted proximate said front end for back and forth movement about a common axis, said common axis being located proximate and above said front end and below said upper end;

resistance means positioned and connected to frictionally resist back and forth pivotal movement of said first and second rigid lever arms; and locking means for selectively locking said first and second rigid lever arms in a non-moving position.

2. A treadmill having structure operable for exercising the upper body of a user, said treadmill comprising:

a frame having a front end, a rear end, and laterally spaced right and left sides;

a movable endless belt rotatably mounted to said frame rearward of said front end and between said right and left sides, said endless belt being formed to support a user thereon;

first and second rigid lever arms each having an upper end and each being pivotally mounted proximate said front end for back and forth movement about a common axis, said common axis being located proximate and above said front end and below said upper end;

resistance means positioned and connected to frictionally resist back and forth pivotal movement of said first and second rigid lever arms; and locking means associated with said treadmill to selectively inhibit rearward movement of said left lever arm and said right lever arm.

3. A treadmill comprising:

a frame having a front cross member and right and left sides;

a front roller connected between said left and right sides;

a rear roller connected between said left and right sides rearward of said front roller;

a deck secured to and between said left and right sides;

an endless belt trained about said rear roller and said front roller and over said deck to be movable over said deck;

a front section forward of said front roller, said front section including said front cross member;

a bracket connected to said front section to extend upwardly therefrom;

an upright member associated with said bracket to extend upwardly therefrom, said upright member being movable between a first position in which said upright member extends upwardly from said bracket and a second position in which said upright member is displaced from said first position toward said endless belt;

first securing means associated with said upright member for securing said upright member to said front section in said first position;

a left rigid handle rotatably attached to said bracket and sized to extend upwardly therefrom for grasping and for back and forth movement by an upright user positioned on said endless belt;

a right rigid handle rotatably attached to said bracket and sized to extend upwardly therefrom for grasping and for back and forth movement by an upright user positioned on said endless belt;

a resistance structure connected to resist back and forth movement of said left rigid handle and said right rigid handle; and a locking structure that selectively inhibits movement of said left rigid handle and said right rigid handle.

4. The treadmill of claim 3, wherein said left rigid handle and said right rigid handle are each rotatably secured either to said bracket or said upright member by second securing means.

5. The treadmill of claim 4, wherein said second securing means is a common axle.

* * * * *